US011011858B2

(12) United States Patent
Li et al.

(10) Patent No.: US 11,011,858 B2
(45) Date of Patent: May 18, 2021

(54) MULTIPLE BUSSED TERMINATIONS

(71) Applicants: TE Connectivity India Private Limited, Bangalore (IN); Tyco Electronics (Shanghai) Co. Ltd., Shanghai (CN); TE Connectivity Corporation, Berwyn, PA (US)

(72) Inventors: Sheng Li, Shanghai (CN); Kurt Allen Randolph, Etters, PA (US); P. K. Senthil Kumar, Bengaluru (IN); Yongjian Huang, Shanghai (CN)

(73) Assignees: TE Connectivity India Private Limited, Bangalore (IN); Tyco Electronics (Shanghai) Co. Ltd., Shanghai (CN); TE Connectivity Corporation, Berwyn, PA (US)

( * ) Notice: Subject to any disclaimer, the term of this patent is extended or adjusted under 35 U.S.C. 154(b) by 17 days.

(21) Appl. No.: 16/430,802

(22) Filed: Jun. 4, 2019

(65) Prior Publication Data

US 2019/0379143 A1 Dec. 12, 2019

(30) Foreign Application Priority Data

Jun. 6, 2018 (IN) ..... 201841021144

(51) Int. Cl.
*H01R 4/18* (2006.01)
*H01R 4/20* (2006.01)
(Continued)

(52) U.S. Cl.
CPC ..... *H01R 4/184* (2013.01); *H01R 4/206* (2013.01); *H01R 4/2495* (2013.01); *H01R 43/048* (2013.01)

(58) Field of Classification Search
CPC ..... H01R 4/184
(Continued)

(56) References Cited

U.S. PATENT DOCUMENTS 2,786,192 A * 3/1957 Wooley, Jr. ..... H01R 43/058 439/880
2,965,147 A * 12/1960 Hoffman ..... H01R 43/058 29/862
(Continued)

FOREIGN PATENT DOCUMENTS

DE 9217344 U1 2/1993
DE 29621319 U1 2/1997
(Continued)

OTHER PUBLICATIONS

Splice for Heater Wires, SPC Splice, retrieved from http://www.jst-belgium.be/productSeries/php?pid=287&cat=53, on Apr. 12, 2018, 2 pages.
(Continued)

*Primary Examiner* — Neil Abrams
(74) *Attorney, Agent, or Firm* — Barley Snyder

(57) ABSTRACT

A multiple bussed termination for connecting a plurality of wires comprises a plurality of splices each having a base and a region for holding some of the plurality of wires. The splices are connected to each other by a conductive strip extending from the base of a first splice of the plurality of splices to a remainder of the plurality of splices. The splices are each capable of being crimped to some of the plurality of wires.

14 Claims, 8 Drawing Sheets

(51) Int. Cl.
*H01R 4/2495* (2018.01)
*H01R 43/048* (2006.01)

(58) Field of Classification Search
USPC ..... 877/877, 880, 882; 174/87
See application file for complete search history.

(56) References Cited

U.S. PATENT DOCUMENTS 3,437,981 A * 4/1969 Keller ..... H01R 4/4836 439/463
3,739,470 A * 6/1973 Eppler ..... H01R 4/20 29/872
3,922,480 A 11/1975 Woofter et al.
4,065,637 A * 12/1977 Allison ..... H01R 4/203 174/87
4,143,237 A * 3/1979 Atkins ..... H01R 4/22 174/87
7,125,295 B2 * 10/2006 Zhao ..... H01R 11/12 439/883
7,601,037 B2 * 10/2009 Telakowski ..... H01R 4/186 439/879
8,303,351 B2 * 11/2012 Taguchi ..... H01H 85/22 439/763
8,622,773 B2 * 1/2014 Curnis ..... H01H 1/5822 439/880
9,257,757 B2 2/2016 Adachi et al.
9,509,074 B2 11/2016 Otsuta
10,361,527 B2 * 7/2019 Schmidt ..... H01R 4/184
2002/0022414 A1 2/2002 Kitagawa et al.
2014/0287621 A1 9/2014 Smutny et al.
2014/0342621 A1 11/2014 Omori et al.
2016/0248212 A1 8/2016 Schmidt et al.
2019/0379143 A1 * 12/2019 Li ..... H01R 4/184

FOREIGN PATENT DOCUMENTS

EP 2458685 A1 5/2012
JP 2014216267 A 11/2014
WO 20090147754 A1 12/2009

OTHER PUBLICATIONS

Cluster Pin Terminal, retrieved from http://www.jst-belgium.be/productSeries.php?pid=284&cat=44, on Apr. 12, 2018, 1 page.
Extended European Search Report, European Patent Application No. 19178370.3, dated Oct. 22, 2019, 7 pages.
Abstract of EP2458685, dated May 30, 2012, 1 page.
Intellectual Property Office India, Examination Report, dated Mar. 15, 2021, 5 pages.

* cited by examiner

MULTIPLE BUSSED TERMINATIONS

CROSS-REFERENCE TO RELATED APPLICATION

This application claims the benefit of the filing date under 35 U.S.C. § 119(a)-(d) of Indian Patent Application No. 201841021144, filed on Jun. 6, 2018.

FIELD OF THE INVENTION

The present invention relates to electrical terminations and, more particularly, to multiple bussed electrical terminations.

BACKGROUND

In electronics and electrical engineering, a large number of electromechanical connections are used to transmit electrical currents, electrical voltages, and/or electrical signals with the greatest possible range of currents, voltages, and frequencies and/or data rates. Such connections must temporarily or permanently ensure correct transmission of electrical power or electrical signals. Therefore, a large number of specially constructed electromechanical contacts, in particular, crimp contacts are known.

A crimp connection is a solderless connection. Crimp connections are advantageous over normal pinching of a terminal on to the end of a wire. The shape of the crimp and amount of pressure applied must be correct in order to obtain the desired performance and durability of the connection. Improper crimp connection may generate heat due to poor electrical connection, and may result in the rework of the product, increasing scrap and in extreme cases resulting in catastrophic failure.

Electrical terminals are often used to terminate the ends of wires. Such electrical terminals typically include an electrical contact and a crimp barrel. In some terminals, the crimp barrel includes an open area that receives an end of the wire therein. The crimp barrel is crimped around the end of the wire to establish an electrical connection between electrical conductors in the wire and the terminal, as well as to mechanically hold the electrical terminal on the wire end. When crimped over the wire end, the crimp barrel establishes an electrical and mechanical connection between the conductors of the wire and the electrical contact.

In addition to a permanent electrical connection, a permanent mechanical connection must also be produced between the cable and a conductor crimp region of the crimp contact. For an electromechanical connection, the crimp contact has a conductor crimp region, and in most cases an insulation crimp region for the cable. Miniaturization and cost savings are forcing manufacturers towards smaller and thinner contacts.

Crimp connections establish an electrical contact and provide a mechanically resilient connection between a crimping base and at least one electrical conductor, which can consist of one or more individual wires. The crimp barrel before being attached to the wire usually comprises of a metal plate, which is bent to have a U- or V-shaped cross-section, or has a rectangular cross-section with a flat base. The underside of the U- or V-shape is hereinafter referred to as crimp base. The upwardly pointing legs of the U- or V-shape are generally known as crimp walls.

Contact reliability decreases with an increasing number of wires in a crimp connection. In particular, when splicing a plurality of conductors which have a number of individual wires, providing an interconnection can be cumbersome.

SUMMARY

A multiple bussed termination for connecting a plurality of wires comprises a plurality of splices each having a base and a region for holding some of the plurality of wires. The splices are connected to each other by a conductive strip extending from the base of a first splice of the plurality of splices to a remainder of the plurality of splices.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
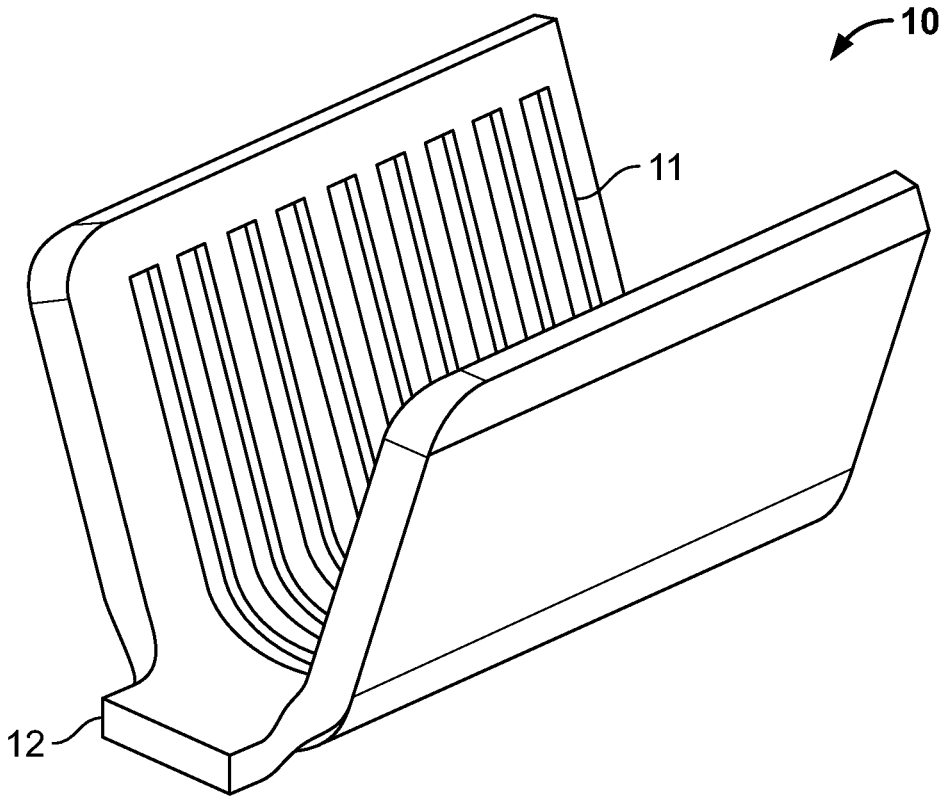
FIG. 1 is a perspective view of a crimp splice according to an embodiment.

The invention is explained in greater detail below with reference to embodiments and the appended drawings. Elements or components which have an identical, univocal or similar construction and/or function are referred to in various Figures of the drawings with the same reference numerals. Benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

Specific embodiments of the present disclosure are described below. Note, however, that an excessively detailed description may be omitted. For example, a detailed description of an already well-known matter and a repeated description of substantially identical components may be omitted. This is intended to avoid unnecessary redundancies of the following description and facilitate understanding of persons skilled in the art. It should be noted that the inventors provide the accompanying drawings and the following description so that persons skilled in the art can fully understand the present disclosure, and that the accompanying drawings and the following description are not intended to limit the subject matters recited in the claims.

Prior to a description of embodiments of the present disclosure, underlying knowledge forming the basis of the present disclosure is described.

Crimping is a non-linear process which involves plastic deformation of both the conductor and the crimp wire barrel. In addition, one has to take into account the contact of multiple bodies of wire strands, a crimp barrel, an anvil, and a crimper for analyzing the mechanics of crimping. The crimp segment is used for realizing the electrical and mechanical connections using a crimping device. The crimping device crimps a crimping segment to a wire. In an embodiment, the electrical wire has electrical conductors that are received in a crimp barrel. For example, an end segment of the wire has exposed conductors that are loaded into the crimp barrel. During a crimping operation, the barrel is crimped around the conductors forming a mechanical and electrical connection between the crimp segment and the electrical wire.

The crimping operation entails forming the crimp segment to mechanically hold the conductors and to provide an engagement between the conductors and the crimp segment. The forming of the terminal may include bending arms or tabs around the wire conductors as in an open terminal (e.g., "F" type crimp), or compressing a closed barrel around the wire conductors as in a closed terminal (e.g., "O" type crimp). As the terminal is formed around the wires during the crimping action, the metal of the terminal and/or of the conductors within the terminal may be extruded. It is desirable to provide a secure mechanical connection, and a good quality electrical connection between the terminal and the electrical wire. Using the embodiments of crimp tooling as disclosed herein creates a formed feature on the terminal that is formed during the crimping operation due to the extrusion of the metal(s). With this tooling, the formed feature can be formed on various types of terminals with varying terminal shapes and designs.

A serrated crimp splice 10, as shown in FIG. 1, has a plurality of serrations 11 and an end feed carrier 12. The main function of crimped connections is to conduct current; the quality of the crimp connection is judged by its electrical resistance. However, initial electrical resistance can hardly be chosen as a good indicator of future crimp reliability, because throughout their life cycle, crimps will be subjected to temperature swings, mechanical abuse, and/or harsh environments. All of these factors can potentially result in contact degradation and in increase of contact resistance. The crimp splice 10 may also be referred to as a crimp barrel 10 or a crimp segment 10.

Internal crimp designs, such as the serrations 11, also contribute to the quality of crimping connection. Serrations 11 are impressions that are created either by removing or displacing material on the inside of the crimp barrel. The serrations 11 in a crimp terminal serve to provide better contact. High pressure during the crimping deforms the conductor and pushes it into the serration cavities and as it flows over the edge of serrations 11, the surface of the wire gets scraped and cleaned from oxides or organic films, thus providing a better electrical contact. The serrations 11 contribute to the mechanical stability by bringing clean metallic surfaces together with sufficient pressure that allows "cold welding" to occur. Furthermore, deformation of the conductor into the serrations 11 provides a mechanical "lock", which improves mechanical stability of the crimp. The splice 10 of FIG. 1, in an embodiment, will accept wire sizes and combinations within the range of 400 to a combined total of 22,000 circular mil area (CMA).

The crimp barrel 10, as shown in FIG. 1, has a base and two opposing side walls extending from the base and forming a region for holding the wires. An inner surface of the region has plurality of serrations 11 extending from one wall to the opposing wall. The end feed carrier 12 is arranged at the base of the crimp barrel 10.

Figure 2A:
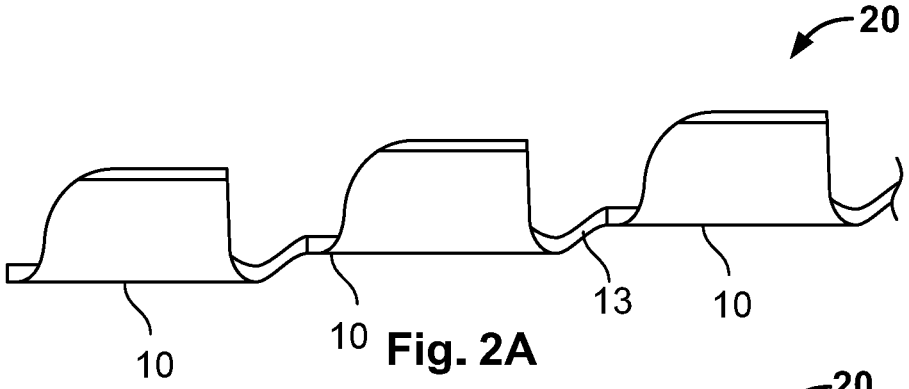
FIG. 2A is a side view of a multiple bussed termination according to an embodiment.
Figure 2B:
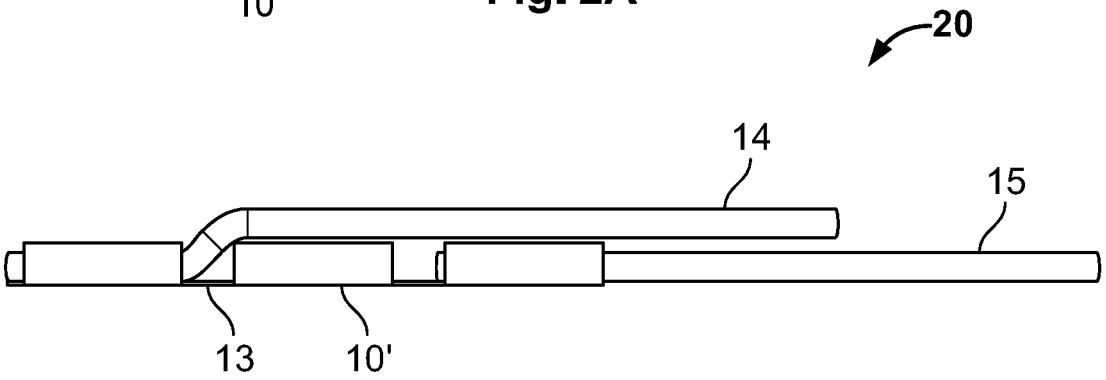
FIG. 2B is a side view of a multiple bussed termination according to another embodiment.

A multiple bussed termination 20 according to an embodiment is shown in FIGS. 2A and 2B. The multiple bussed terminal 20 includes a plurality of splices 10 or crimps 10 connected to each other by a conductive strip 13 and forming a conductive path between the splices 10. The splices 10 may be arranged along the conductive strip 13 displaced stepwise vertically, as shown in FIG. 2A, or may be arranged at a same height in a vertical direction, as shown in FIG. 2B. In an embodiment, an intermediate splice 10' shown in FIG. 2B, without a wire, is used for challenging wire packing situations; with this arrangement, a first conductor 14 having a first set of wires is spliced with a second conductor 15 having a second set of wires.

Figure 3A:
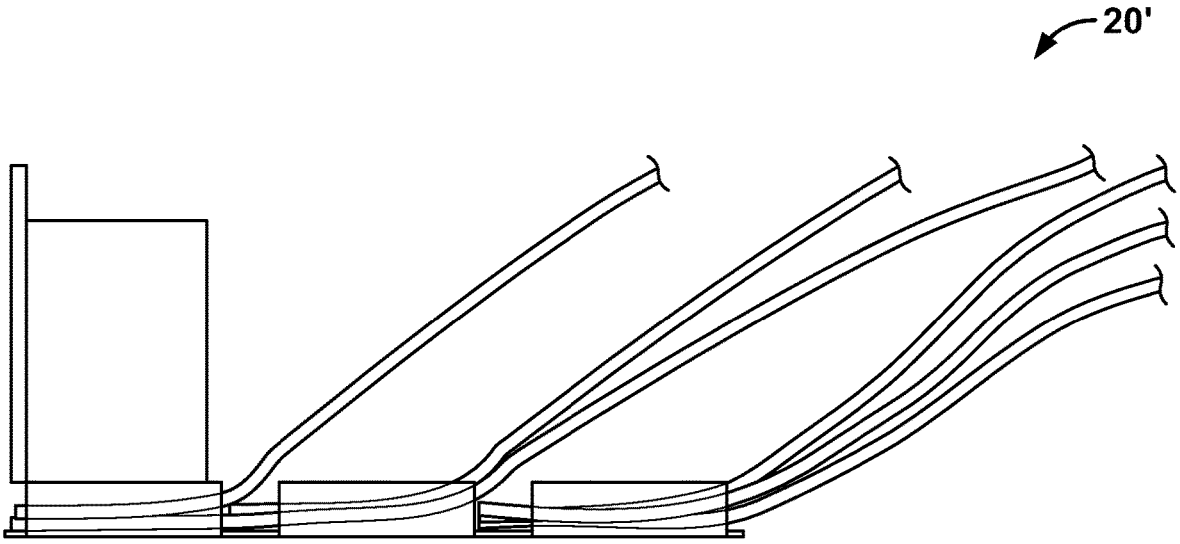
FIG. 3A is a side view of a multiple bussed termination according to another embodiment.
Figure 3B:
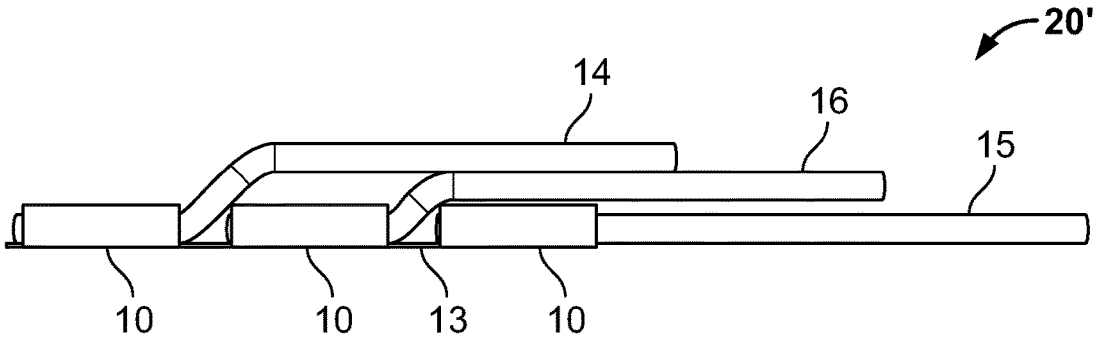
FIG. 3B is a side view of the multiple bussed termination of FIG. 3A.

A multiple bussed termination 20' according to another embodiment having three splices 10 is shown in FIGS. 3A and 3B. With the termination 20', a first conductor 14 having a first set of wires is spliced with a second conductor 15 having a second set of wires. Sandwiched between these two conductors is a third conductor 16 having a third set of wires. At approximately 4600-5000 CMA there is 0.050 inches or more extrusion, which occupies all the carrier space and causes stress on the carrier from the next set of wires pressing down on the brush from the previous crimp. At around 0.29 inches beyond the crimp barrel is the position of wire when the crimp starts.

The group of connected splices 10 in the multiple bussed termination 20 allows the electrical leads to electrically connect and with more wires than would be able to fit within a single barrel of a splice 10. For example, if a single terminal can accommodate three wires, then a group of three terminals can electrically connect nine wires. Such connected terminals allow crimping of a maximum of nine wires, thereby increasing the crimp capacity. This in turn increases the usage range.

Figure 3C:
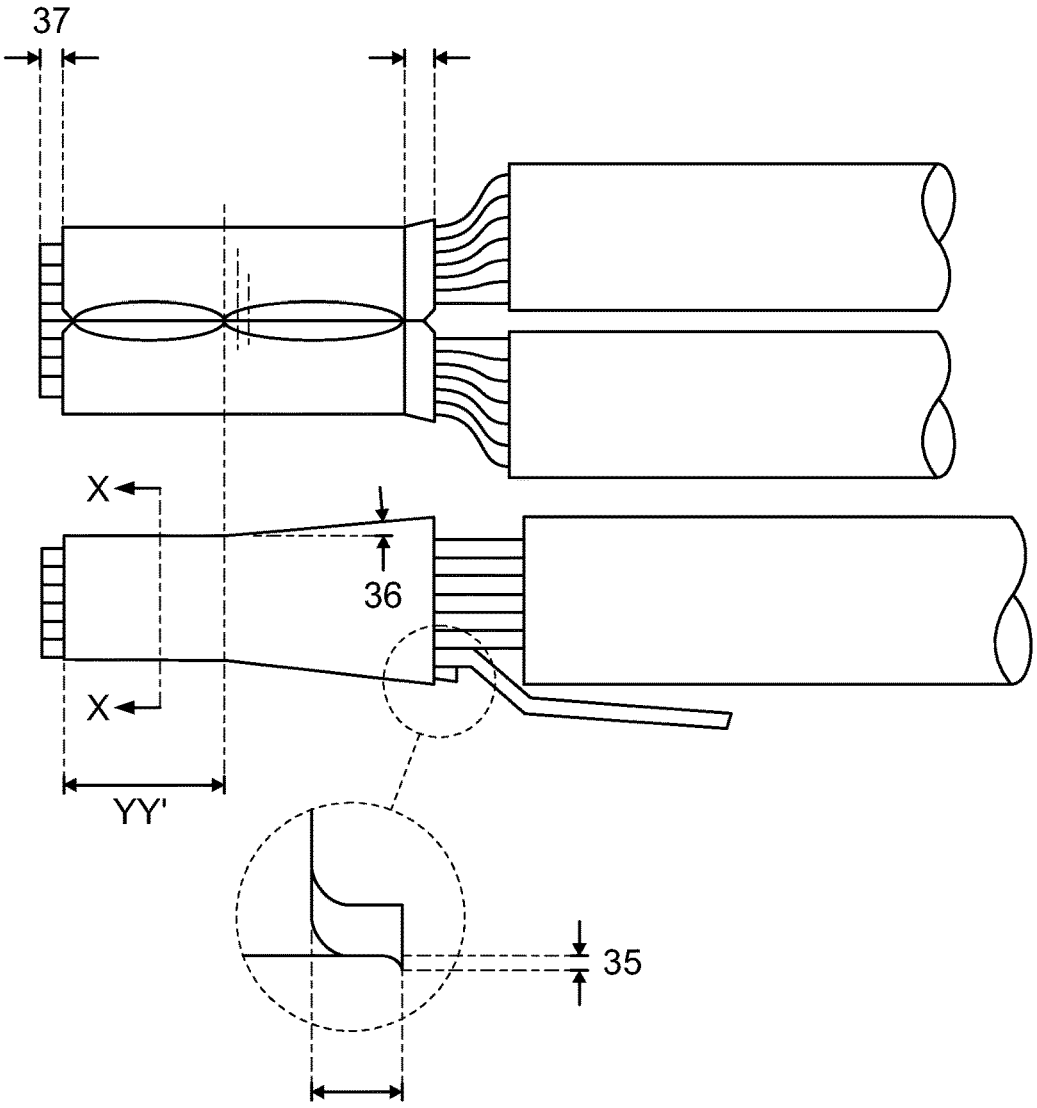
FIG. 3C is a top view of a crimp connection according to an embodiment.
Figure 3D:
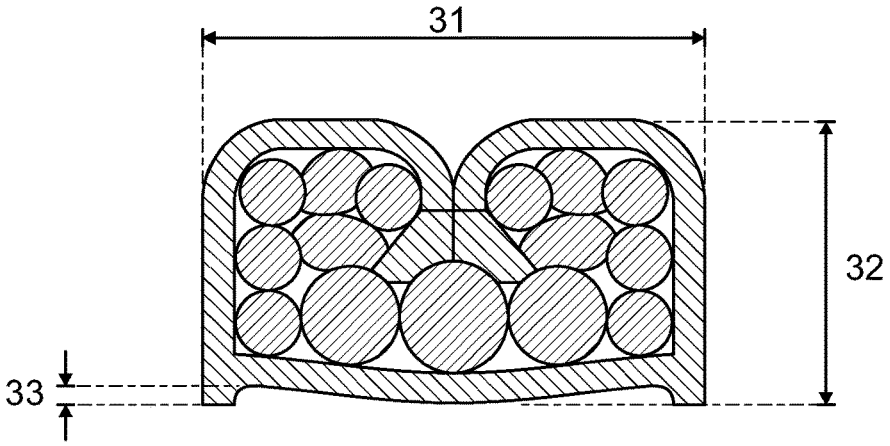
FIG. 3D is a sectional end view of the crimp connection of FIG. 3C.

FIGS. 3C and 3D show various parameters used for characterizing crimp connection according to the present disclosure, namely a crimp width 31, a crimp height 32, and a wire barrel flash 33, 35. Optimum electrical and mechanical performance is achieved by reducing the cross-sectional area of the wires and splice by a predetermined percentage. Crimp height 32 and crimp width 31 is fixed in the application tooling. Effective crimp length over the portion YY' of the bussed connection is 50% minimum of the total crimp length. Wire barrel flash 33, 35 which can be caused by incorrect set up and/or worn and broken crimp tooling, does not exceed 0.20 mm. Crimp tapers 36 contribute to crimp effectiveness and reduce the risk of nicked and/or broken conductor strands due to sharp material edges at the ends of the splice. As shown in FIG. 3C, ends of each of a pair of opposing side walls of the crimp are adapted to engage one another with a rear end of the crimp having the taper 36 at an upper side and a lower side of the rear end. In the embodiment shown in FIG. 3C, the rear end of the crimp has a bell mouth shape.

Conductors 37 must extend completely through the splice. Excess magnet wire and lead wire strands will be trimmed off by the application equipment. The splice seam must be closed with no evidence of loose wire strands visible in the seam; ends of each of a pair of opposing side walls of the crimp are adapted to engage one another along a completely closed seam. Single wire strand exposure may occur in the seam beyond effective crimp length.

Figure 4A:
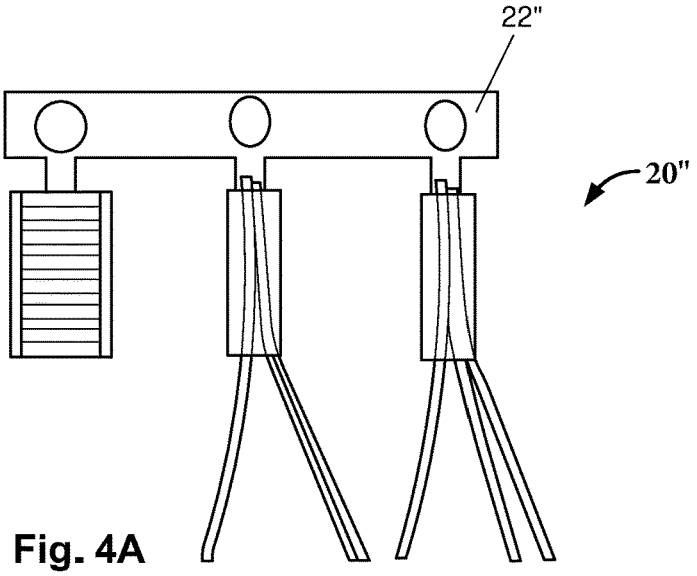
FIG. 4A is a top view of a multiple bussed termination according to another embodiment.
Figure 4B:
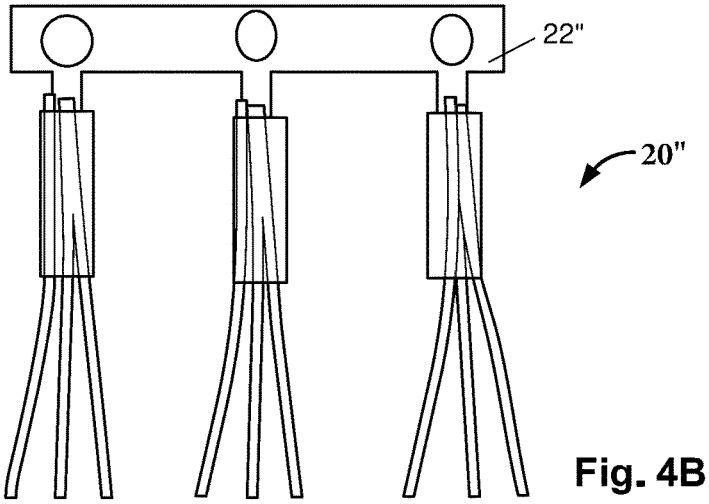
FIG. 4B is a top view of the multiple bussed termination of FIG. 4A.
Figure 4C:
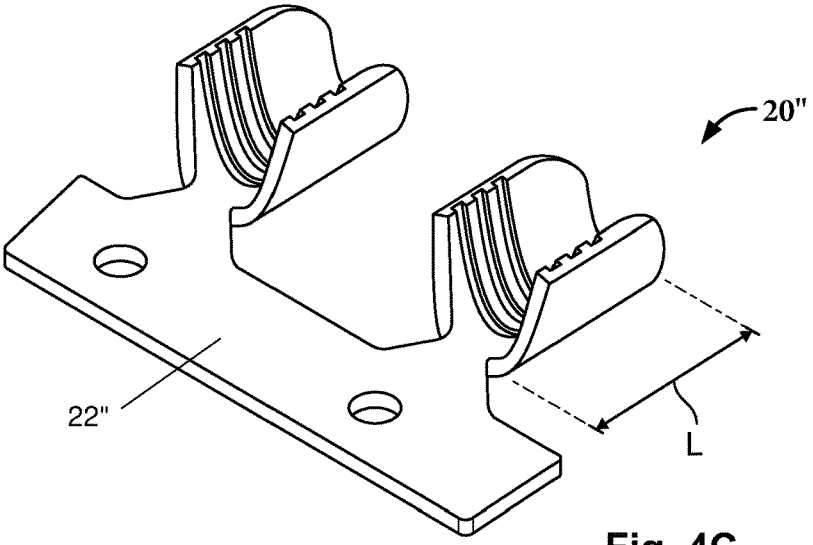
FIG. 4C is a perspective view of the multiple bussed termination of FIG. 4A.

FIGS. 4A, 4B and 4C are schematic views of a multiple bussed termination 20" according to another embodiment. The multiple bussed termination 20" is suitable for a side-feed carrier 22". The side feed carrier 22" at the front end of the multiple bussed connection 20", according to the embodiment, extends the range of the standard single crimping. End feeding or side feeding can be used in various embodiments.

Various materials and alloys could be used as base materials of the multiple bussed terminations 20, 20', 20" described above. The choice of the base material depends on the use and advantages that the chosen material or combination of the materials adapted to the specific application scenario offer. The base material can be selected from brass, phosphor bronze, steel copper alloys or any combination thereof. In another embodiment, the base material is an alloy of copper and steel. In an embodiment, the multiple bussed termination 20, 20', 20" can be plated. The multiple bussed terminations 20, 20', 20" are suitable for but not limited to use with metallic wires like copper and aluminum or combinations thereof.

Tooling application requirements for the multiple bussed terminations 20, 20', 20" of FIGS. 2-4 will now be described in greater detail below.

Figure 5:
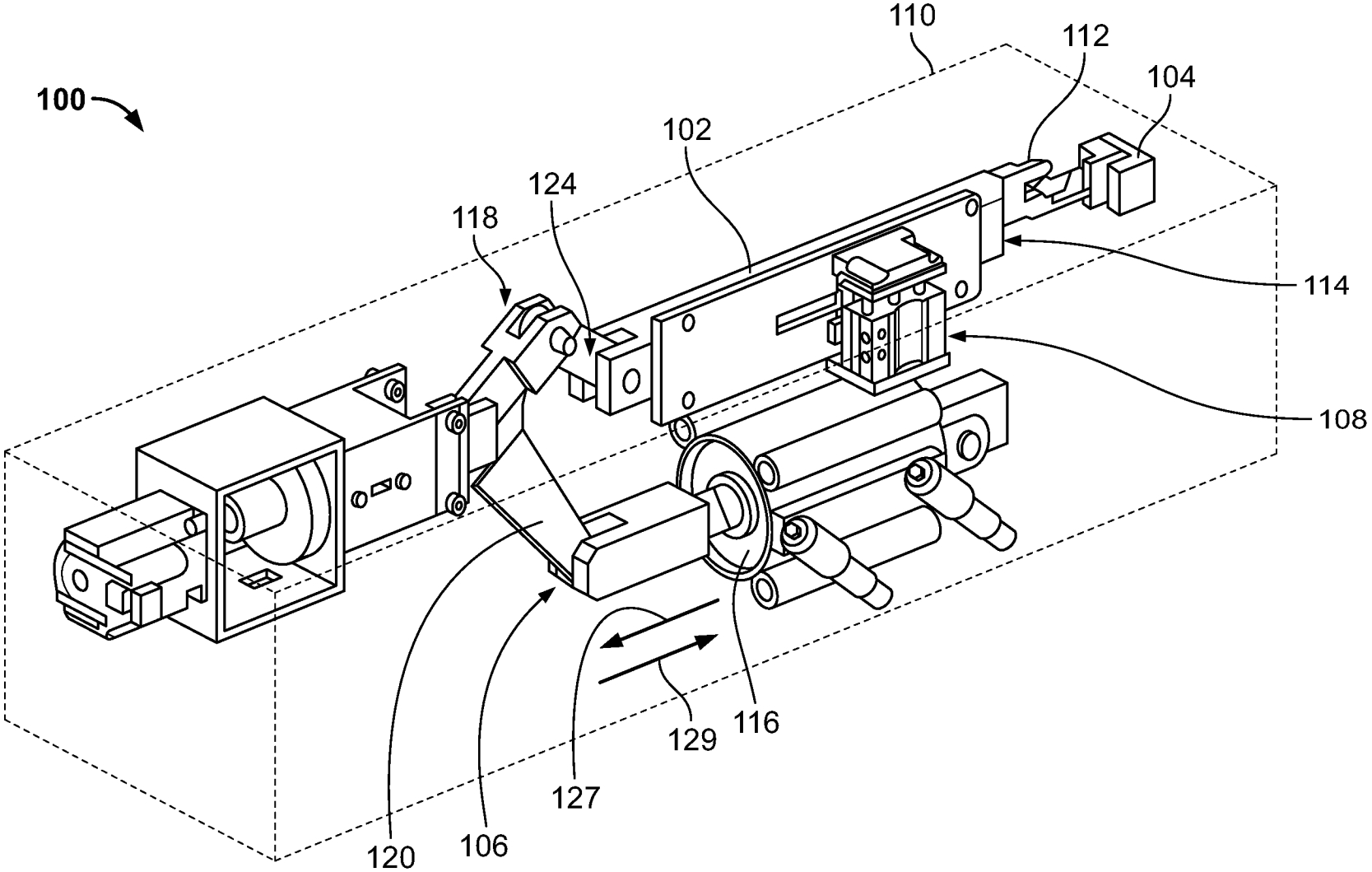
FIG. 5 is a perspective view of a powered termination machine according to an embodiment.

A powered termination machine 100 according to an embodiment is shown in FIG. 5. The powered termination machine 100 is configured to repeatedly crimp terminals 202 onto corresponding wires 204, shown in FIG. 6, to produce a series of electrical leads for use in various applications, such as machines, appliances, automobiles, and the like. In an embodiment, the wires 204 may be magnet wires used for electrical windings of an induction motor, generator, transformer, or the like. The termination machine 100 may crimp one or multiple magnet wires 204 into each terminal 202 to electrically connect the magnet wires 204.

The termination machine 100, as shown in FIG. 5, includes a movable ram 102, a stationary anvil 104, a drive assembly 106 operatively connected to the ram 102, and a shearing assembly 108. The termination machine 100 also includes a housing 110 or case. The housing 110 at least partially surrounds the other components 102, 104, 106, 108 of the termination machine 100 to prevent injuries to operators, blocks the entrance of debris and contaminants into the termination machine 100, and the like. The anvil 104 is secured in a fixed position relative to the housing 110. In various embodiments, the anvil 104 may be secured directly to the housing 110 or to a base within the housing 110. The shearing assembly 108 is operatively connected to the ram 102. The shearing assembly 108 is configured to selectively break or sever bridge segments 210 of a carrier strip 208, shown in FIG. 6, between adjacent terminals 202 on the carrier strip 208.

The ram 102 moves reciprocally relative to the anvil 104 between an extended position and a retracted position. The ram 102 is located closer to the anvil 104 in the extended position than in the retracted position. During a crimp stroke of the ram 102, the ram 102 moves from the retracted position towards the anvil 104 to the extended position, and subsequently retreats in a direction away from the anvil 104 to the retracted position to complete the crimp stroke. As the ram 102 moves towards the anvil 104 (and the extended position) during the crimp stroke, the ram 102 crimps a corresponding terminal 202 shown in FIG. 6 against the anvil 104. In the embodiment shown in FIG. 6, the ram 102 includes crimp tooling 112 that extends from a crimp end 114 of the ram 102. The crimp tooling 112 engages the terminal 202, and compresses or sandwiches the terminal 202 between the crimp tooling 112 and the anvil 104, to crimp the terminal 202 onto the one or more wires 204 within the terminal 202.

In the embodiment shown in FIG. 5, the drive assembly 106 includes an actuator 116 that is mechanically connected to the ram 102 via a linkage 118. The linkage 118 includes a bell crank or rocker 120. The actuator 116 is a linear pneumatic cylinder in the shown embodiment, but may be another type of powered actuator, such as an electrical step motor, a hydraulic actuator, a magnetic actuator, or the like, in other embodiments. The actuator 116 may be coupled to an air hose that supplies pressurized gas to the actuator 116 to provide a source of power. The rocker 120 is pivotally connected to a mounting end 124 of the ram 102. The mounting end 124 is opposite to the crimp end 114 of the ram 102 that couples to the crimp tooling 112. The ram 102 is disposed vertically above the actuator 116. Due to the function of the rocker 120, the movement of the linear actuator 116 in one direction drives the ram 102 in an opposite direction; the actuator 116 moves in a first direction 127 towards the rocker 120 to drive the ram 102 along the crimp stroke towards the extended position and the anvil 104, and the actuator 116 moves in a second direction 129 away from the rocker 120 to retract the ram 102.

Figure 6:
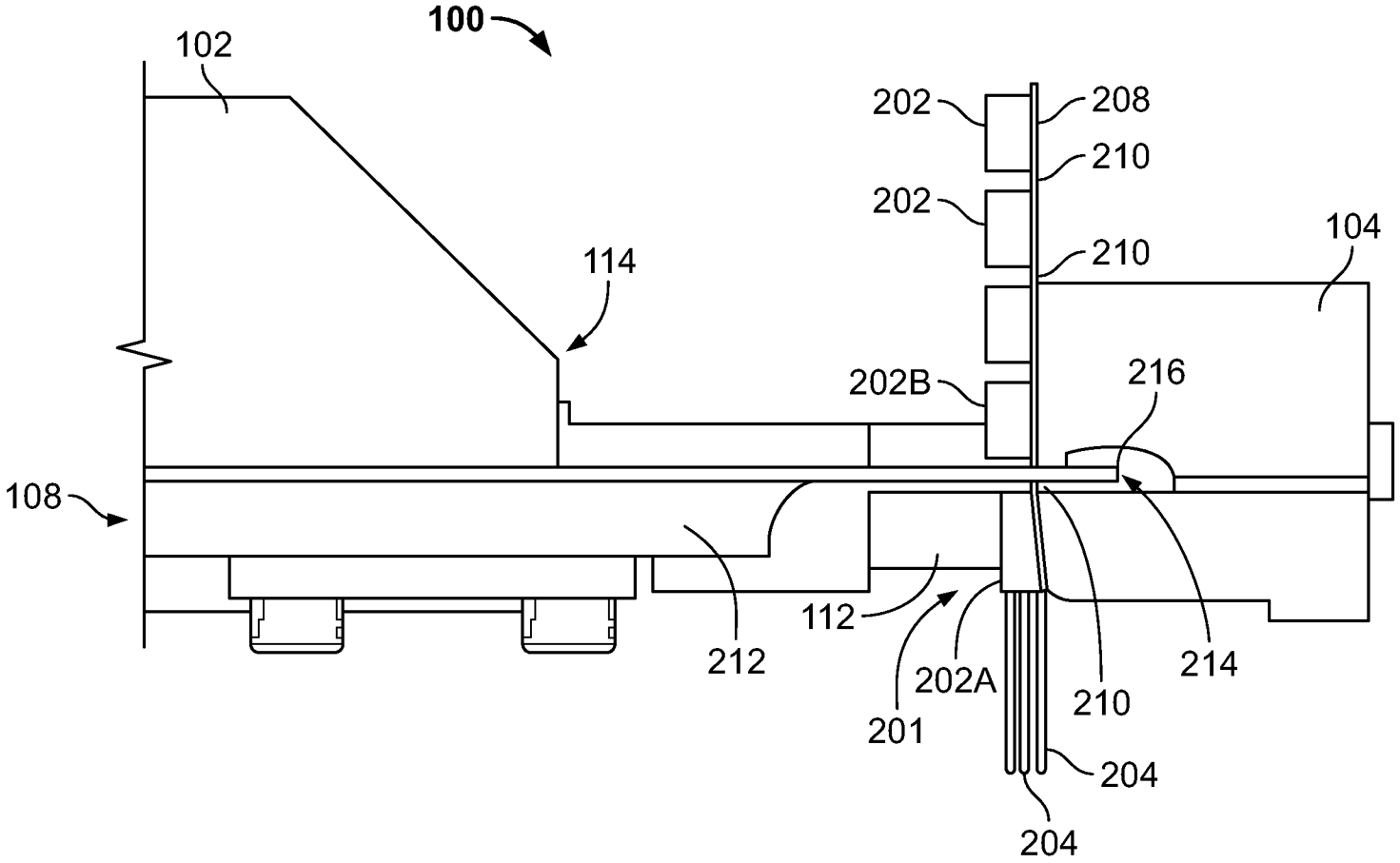
FIG. 6 is a plan view of a crimp zone of the termination machine of FIG. 5.

A crimp zone 201 of the termination machine 100 that includes the anvil 104 and the crimp tooling 112 at the crimp end 114 of the ram 102 is shown in FIG. 6. A series of terminals 202 on a carrier strip 208 are fed to the crimp zone 201. The terminals 202 may be fed to the crimp zone 201 by an automated feeder device.

The shearing assembly 108, as shown in FIG. 6, includes a shearing arm 212 that is mounted to the ram 102. The shearing arm 212 moves with the movement of the ram 102 towards the anvil 104 during the crimp stroke. The shearing arm 212 projects beyond the crimp end 114 of the ram 102 to a distal end 214 of the shearing arm 212. The shearing arm 212 has a blade 216 at the distal end 214. The shearing arm 212 is adjustable relative to the ram 102 between a cutting position and a non-cutting position. The shearing arm 212 projects farther from the crimp end 114 of the anvil 104 in the cutting position than in the non-cutting position.

In FIG. 6, the ram 102 is in the extended position and the shearing arm 212 is in the cutting position. Prior to each crimp stroke, the carrier strip 208 is advanced such that one of the terminals 202, identified as 202A in FIG. 6, aligns between the anvil 104 and the crimp tooling 112. One or more wires 204 are loaded into a barrel of the terminal 202A. As the ram 102 moves towards the extended position during the crimp stroke, the crimp tooling 112 compresses the terminal 202A against the anvil 104, crimping the terminal 202A onto the wires 204. While the terminal 202A is crimped, the blade 216 of the shearing arm 212 strikes the bridge segment 210 of the carrier strip 208 that is between the crimped terminal 202A and the adjacent, uncrimped terminal 202, identified as 202B in FIG. 6. The blade 216 breaks through or severs the bridge segment 210, mechanically separating the crimped terminal 202A from the uncrimped terminal 202B and the other terminals 202 on the carrier strip 208.

As shown in FIG. 6, when the shearing arm 212 is in the cutting position, during each crimp stroke the blade 216 severs the bridge segment 210 of the carrier strip 208 between the terminal 202 being crimped and the adjacent, uncrimped terminal 202. As shown and described herein, when the shearing arm 212 is in the non-cutting position, the blade 216 does not sever the bridge segment 210 during the crimp stroke. As a result, the bridge segment 210 is left intact and the crimped terminal 202, terminal 202A in FIG. 6, remains mechanically connected to the adjacent, uncrimped terminal 202, for example terminal 202B in FIG. 6.

Figure 7:
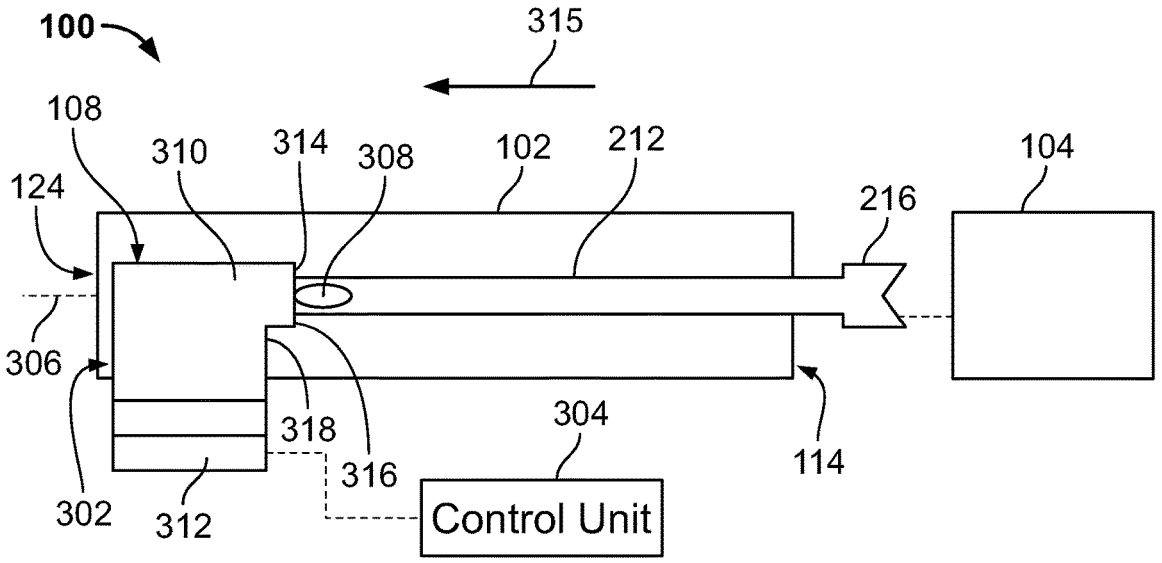
FIG. 7 is a side view of the termination machine of FIG. 5 with a ram in a retracted position and a shearing arm in a cutting position.
Figure 8:
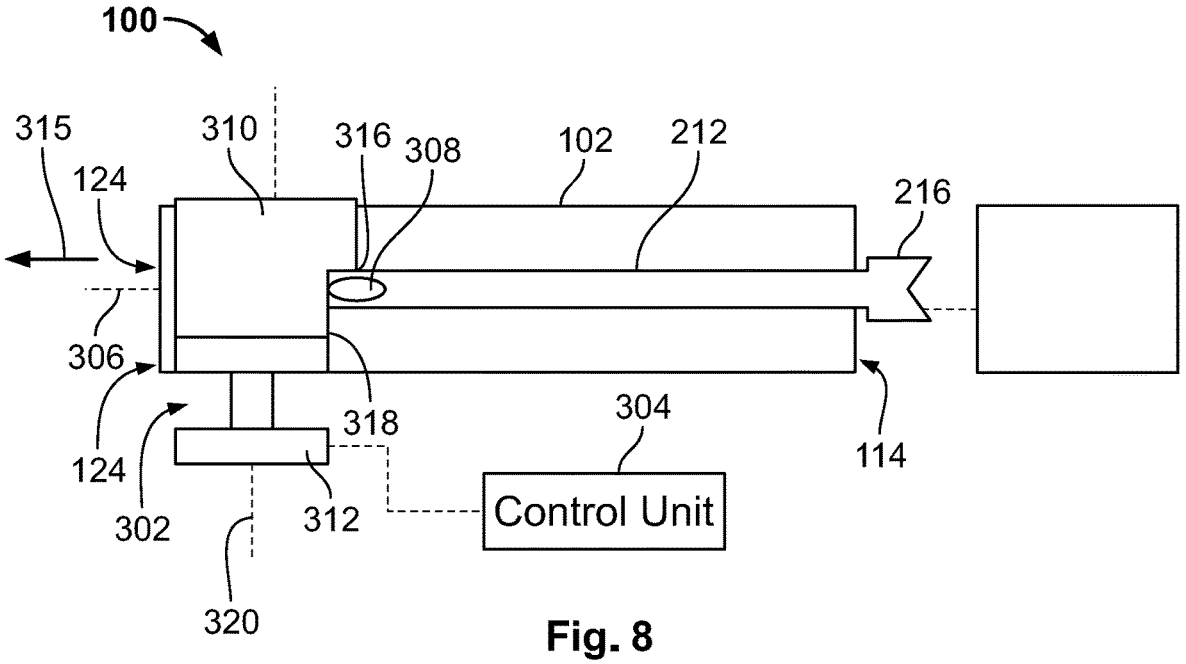
FIG. 8 is a side view of the termination machine of FIG. 5 with the ram in the retracted position and the shearing arm in a non-cutting position.
Figure 9:
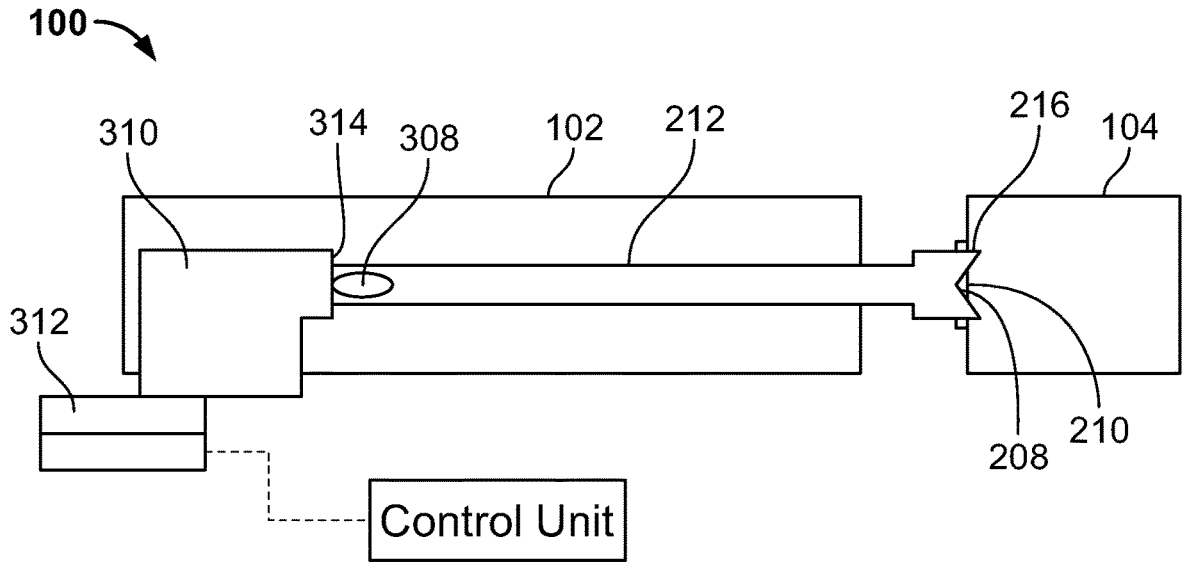
FIG. 9 is a side view of the termination machine of FIG. 5 with the ram in an extended position and the shearing arm in the cutting position.
Figure 10:
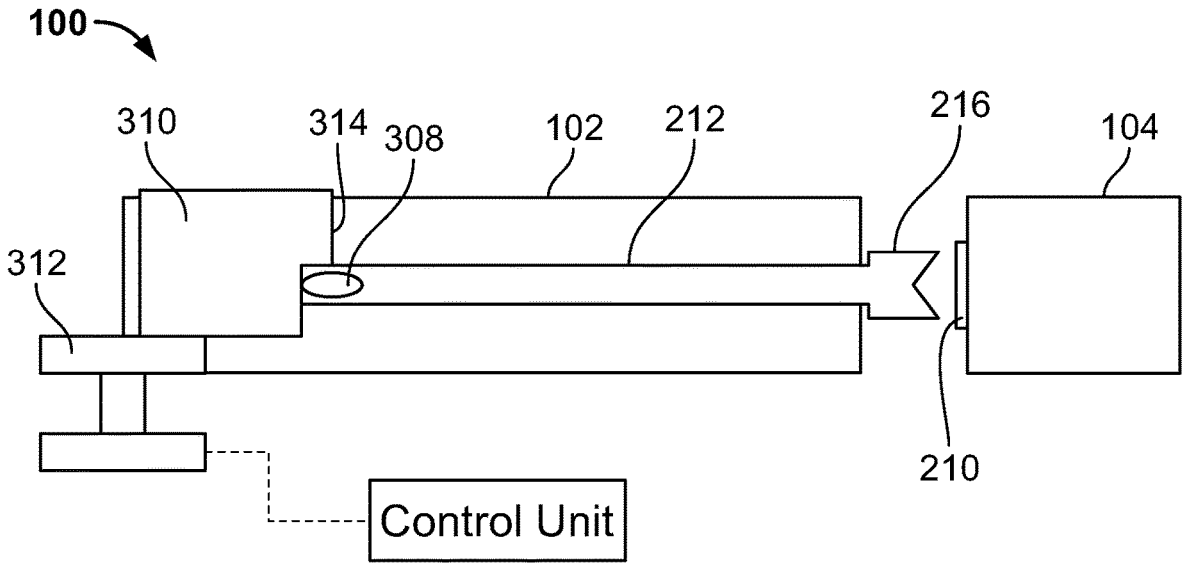
FIG. 10 is a side view of the termination machine of FIG. 5 with the ram in the extended position and the shearing arm in the non-cutting position.

The termination machine 100 is shown in FIG. 7 with the ram 102 in the retracted position and the shearing arm 212 of the shearing assembly 108 in the cutting position. The components of the termination machine 100 shown in FIG. 7, as well as in FIGS. 8-10, are schematically illustrated with simplified, generic shapes and sizes for descriptive purposes. The schematic components shown in FIGS. 6-9 may not correspond to the actual shapes and/or sizes of the associated physical, real-world components of the termination machine 100. The ram 102 extends from the mounting end 124 to the crimp end 114 along a ram axis 306.

In the embodiment shown in FIG. 7, the shearing assembly 108 includes the shearing arm 212, a blade position toggle mechanism 302, also referred to as a toggle mechanism 302, and a control unit 304. The shearing arm 212 is elongated, parallel to the ram axis 306. The shearing arm 212 includes a post 308 projecting laterally from the shearing arm 212. In the shown embodiment, the post 308 projects out of the page. Optionally, the post 308 may extend from the arm 212 through an aperture 708 of the ram 102, shown in FIG. 8.

The toggle mechanism 302 is operatively connected to the post 308 of the shearing arm 212, as shown in FIG. 7. The toggle mechanism 302 is configured to selectively toggle the shearing arm 212 between the cutting position and the non-cutting position via engagement with the post 308. The control unit 304 controls the toggle mechanism 302. The control unit 304 may include one or more processors and a memory. The one or more processors of the control unit 304 may control operations of the toggle mechanism 302 according to programmed instructions stored in the memory or hard-wired into the control unit 304. In an embodiment, the memory is a non-transitory computer readable medium. The control unit 304 may allow an operator to select a designated toggle sequence for the shearing arm 212. Once the sequence is set, the toggle mechanism 302 may automatically toggle the shearing arm 212 between the cutting and non-cutting positions according to the designated toggle sequence.

The toggle mechanism 302 includes a blade switch 310 and a powered actuator 312 connected to the blade switch 310, as shown in FIG. 7. The actuator 312 of the toggle mechanism 302 may be discrete from the actuator 116 of the termination machine 100 shown in FIG. 5. In another embodiment, the actuator 312 may be connected to, or represent a part of, the actuator 116. The blade switch 310 is mounted to the ram 102, and moves with the ram 102 along the crimp stroke. The blade switch 310 may be disposed between the post 308 of the shearing arm 212 and the mounting end 124 of the ram 102. The blade switch 310 includes a cam backstop surface 314 that engages the post 308. In one or more embodiments, the shearing arm 212 is biased relative to the ram 102 in a retracting direction 315 towards the mounting end 124 of the ram 102 (e.g., and away from the anvil 104). The shearing arm 212 may be biased via one or more springs, gravity, tension, or the like, that act on the shearing arm 212. Due to the biasing force exerted on the shearing arm 212, the post 308 of the shearing arm 212 presses against the cam backstop surface 314 of the blade switch 310. The cam backstop surface 314 provides a hard stop that blocks additional movement of the shearing arm 212 in the retracting direction 315 relative to the ram 102. The post 308 remains in engagement with the cam backstop surface 314 during at least a portion of the crimp stroke.

In the embodiment shown in FIG. 7, the cam backstop surface 314 includes a high seat 316 and a low seat 318 adjacent to one another along the cam backstop surface 314. The high seat 316 is stepped a distance away from the low seat 318. The high seat 316 is located closer than the low seat 318 to the crimp end 114 of the ram 102. The high seat 316 is between the low seat 318 and the crimp end 114 along the ram axis 306. In an embodiment, although the blade switch 310 is mounted to the ram 102, the blade switch 310 is movable relative to the ram 102 between a first position and a second position. The movement of the blade switch 310 between the first and second positions causes the shearing arm 212 to toggle between the cutting and non-cutting positions, as described herein. The actuator 312 drives the movement of the blade switch 310. In the first position of the blade switch 310 shown in FIG. 7, the post 308 of the shearing arm 212 aligns with and engages the high seat 316. When the post engages the high seat 316, the shearing arm 212 is in the cutting position.

The termination machine 100 is shown in FIG. 8 with the ram 102 in the retracted position and the shearing arm 212 in the non-cutting position. From the cutting position shown in FIG. 7, the shearing arm 212 moves parallel to the ram axis 306 in the retracting direction 315 towards the mounting end 124 of the ram 102 to attain the non-cutting position. The blade 216 of the shearing arm 212 is located closer to the crimp end 114 of the ram 102 in the non-cutting position relative to the cutting position.

In order to toggle the shearing arm 212 from the cutting position to the non-cutting position, the powered actuator 312 moves linearly to drive the blade switch 310, relative to both the ram 102 and the shearing arm 212, from the first position shown in FIG. 6 to the second position shown in FIG. 8. In an embodiment, the actuator 312 moves the blade switch 310 between the first and second positions along a switch axis 320 that is perpendicular to the ram axis 306. The movement of the blade switch 310 along the switch axis 320 causes the shearing arm 212 to move in a direction that is approximately 90 degrees, in various embodiments within plus or minus 5, 10, or 15 degrees, relative to the switch axis 320. When the blade switch 310 is in the second position, the post 308 of the shearing arm 212 aligns with and engages the low seat 318. For example, the actuator 312 extends, pushing the high seat 316 beyond the post 308 such that the low seat 318 aligns with the post 308. When the post 308 abuts the low seat 318, the shearing arm 212 is in the non-cutting position.

The powered actuator 312 may be a pneumatic actuator, an electrical actuator such as a motor, a hydraulic actuator, a magnetic actuator, or the like. As described above, the position of the shearing arm 212 is controlled by the actuator 312. For example, the shearing arm 212 assumes the cutting position in response to the actuator 312 moving the blade switch 310 to the first position such that the high seat 316 aligns with and engages the post 308 that is biased towards the blade switch 310. Furthermore, the shearing arm 212 assumes the non-cutting position in response to the actuator 312 moving the blade switch 310 to the second position such that the low seat 318 aligns with and engages the post 308.

In an embodiment, the operation of the actuator 312 may be controlled automatically by the control unit 304 in order to toggle the shearing arm 212 between the cutting and non-cutting positions according to a designated sequence. The sequence may include selected numbers of crimp strokes of the ram 102 before toggling the shearing arm 212. For example, one sequence may include setting the shearing arm 212 to the cutting position for one crimp stroke, in order to sever the bridge segment 210 of the carrier strip 208, shown in FIG. 6, then toggling the shearing arm 212 to the non-cutting position for two subsequent crimp strokes, before repeating the sequence. This example sequence yields a plurality of crimped leads that each have three connected terminals 202 shown in FIG. 6. The two crimp strokes with the shearing arm 212 in the non-cutting position leaves a bridge segment 210 intact on both sides of the middle terminal 202. Other designated sequences may produce crimped leads having more or less than three connected terminals 202. Furthermore, the designated sequence may produce more than one type of lead. For example, one sequence may produce a selected number of one-terminal leads, followed by a selected number of two-terminal leads. The operator may select the designated sequence using an input device, such as a touchpad, keyboard, computer mouse, or the like, that communicates with the control unit 304. The control unit 304 may be configured to transmit a wired or wireless signal to the actuator 312 to control the movement of the actuator 312 according to the designated sequence.

In an embodiment, the toggle mechanism 302 switches the position of the shearing arm 212 from the cutting position to the non-cutting position, and vice-versa, while the ram 102 is at the retracted position shown in FIGS. 7 and 8. For example, after completing one crimp stroke and prior to starting a subsequent crimp stroke, the actuator 312 may be controlled to move the blade switch 310 in order to toggle the position of the shearing arm 212.

FIG. 9 is a schematic diagram of the termination machine 100 according to an embodiment showing the ram 102 in the extended position and the shearing arm 212 in the cutting position, as in FIG. 7. FIG. 10 is a schematic diagram of the termination machine 100 according to an embodiment showing the ram 102 in the extended position and the shearing arm 212 in the non-cutting position, as in FIG. 8.

As shown in FIGS. 9 and 10, as the ram 102 moves from the retracted position towards the extended position (and the anvil 104), the blade switch 310 and the shearing arm 212 move with the ram 102. The post 308 of the shearing arm 212 may remain in biased engagement with the cam backstop surface 314 of the blade switch 310 during the movement. The actuator 312, however, does not move with the ram 102 along the crimp stroke. When the shearing arm 212 is in the cutting position shown in FIG. 6, the blade 216 of the shearing arm 212 engages and severs the bridge segment 210 of the carrier strip 208 as the ram 102 moves to the extended position. Conversely, when the shearing arm 212 is in the non-cutting position shown in FIG. 7, the blade 216 may be spaced apart from the bridge segment 210 without engaging the bridge segment 210, even at the extended position of the ram 102.

Next, the mechanics and the behavior of the crimp connection under external forces will be described.

There are two mechanisms for establishing and maintaining permanent contact in a crimp connection, namely cold welding and the generation of an appropriate residual force distribution. Both mechanisms contribute to creating a permanent connection and are independent of each other. During crimping two metal surfaces are brought under an applied force to sliding or wiping actions thus welding the metals in a cold version also known as cold welding. Under an appropriate residual force distribution the contact interface will experience a positive force. During crimping, residual forces are developed between the conductor and the crimp barrel as the crimp tooling is removed which is an indicative of different elastic recovery.

When the electrical conductor tends to spring back more than the crimp barrel, the barrel exerts a compressive force on the conductor which maintains the integrity of the contact interface. The electrical and the mechanical performance of a crimped connection results from a controlled deformation of conductors and crimp barrels, which produce micro cold welded junctions between the conductors and between conductors and the crimp barrel. These junctions are maintained by an appropriate residual stress distribution within the crimped connection, which leads to residual forces that in turn maintain the stability of the junctions.

Dimensions, types of materials, orientations of the various components, and the number and positions of the various components described herein are intended to define parameters of certain embodiments, and are by no means limiting, and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects.

While the present disclosure has been particularly shown and described with reference to exemplary embodiments thereof, it will be understood by those skilled in the art that various changes in form and details may be made therein without departing from the intent of the disclosure as defined by the appended claims. The exemplary embodiments should be considered in descriptive sense only, and not for purposes of limitation. Therefore, the scope of the present disclosure is defined not by the above description of the invention but by the appended claims, and all differences within the scope will be construed as being included in the present invention.

What is claimed is:

1. A multiple bussed termination for connecting a plurality of conductors each having a plurality of wires, comprising:

a plurality of splices each having a base and a region for holding the plurality of wires of at least two of the conductors, the splices are connected to each other by a conductive strip extending from the base of a first splice of the plurality of splices to a remainder of the plurality of splices.

2. The multiple bussed termination of claim 1, wherein at least one of the splices is a serrated crimp.

3. The multiple bussed termination of claim 2, wherein the serrated crimp has an end feed carrier or a side feed carrier at a front end.

4. The multiple bussed termination of claim 3, wherein the region for holding the wires has a pair of opposing side walls extending from the base.

5. The multiple bussed termination of claim 4, wherein an inner surface of the region for holding the wires has a plurality of serrations extending from a first wall to an opposite second wall.

6. The multiple bussed termination of claim 5, wherein the inner surface of the region has at least three serrations.

7. The multiple bussed termination of claim 6, wherein the inner surface of the region has at least nine serrations.

8. The multiple bussed termination of claim 2, wherein each of the splices is a serrated crimp.

9. The multiple bussed termination of claim 2, wherein ends of each of a pair of opposing side walls of the serrated crimp are adapted to engage one another along a completely closed seam.

10. The multiple bussed termination of claim 2, wherein ends of each of a pair of opposing side walls of the serrated crimp are adapted to engage one another with a rear end of the crimp having a taper at an upper side and a lower side of the rear end.

11. The multiple bussed termination of claim 10, wherein the rear end has a bell mouth shape.

12. The multiple bussed termination of claim 1, wherein a base material of each of the splices is an alloy of copper and steel.

13. The multiple bussed termination of claim 1, wherein the termination is plated.

14. The multiple bussed termination of claim 1, wherein the wires are magnetic and/or stranded lead wires.

* * * * *